United States Patent [19]

Daniher et al.

[11] Patent Number: 4,735,628

[45] Date of Patent: Apr. 5, 1988

[54] WET FAST DYED CELLULOSIC MATERIALS

[75] Inventors: Francis A. Daniher, Pittsburgh, Pa.; J. Richard Aspland, Greenville, S.C.

[73] Assignee: Calgon Corporation, Pittsburgh, Pa.

[21] Appl. No.: 831,755

[22] Filed: Feb. 20, 1986

Related U.S. Application Data

[63] Continuation-in-part of Ser. No. 679,412, Dec. 7, 1984, abandoned.

[51] Int. Cl.[4] ..... C09B 67/00

[52] U.S. Cl. ..... 8/555; 8/554

[58] Field of Search ..... 524/253, 410, 420; 8/128.1, 554, 555

[56] References Cited

U.S. PATENT DOCUMENTS 2,606,810 8/1952 Erickson et al. ..... 8/128 R
4,520,143 5/1985 Jelliner ..... 523/410

FOREIGN PATENT DOCUMENTS 56-53292 5/1981 Japan .
56-128382 10/1981 Japan .
57-154481 9/1982 Japan .
4841082 6/1983 Japan .
58-136889 8/1983 Japan .
00791957 4/1979 South Africa .

*Primary Examiner*—Paul Lieberman
*Assistant Examiner*—John F. McNally
*Attorney, Agent, or Firm*—W. C. Mitchell; M. C. Sudol, Jr.

[57] ABSTRACT

The instant invention is directed to a dyed cellulosic material which has been treated with 0.1 to 5%, by weight, based on the weight of said material, of a polymer containing:

(A) 50% to 90%, by weight, based on the total weight of the polymer, of selected cationic mer units;

(B) 10% to 50%, by weight, based on the total weight of the polymer, of selected reactive mer units; and (C) 0 to 25%, by weight, based on the total weight of the polymer of selected inert mer units.

The instant invention is also directed to a process for producing improved wet fast dyed cellulosic material.

8 Claims, No Drawings

WET FAST DYED CELLULOSIC MATERIALS

BACKGROUND OF THE INVENTION

This application is a continuation-in-part of U.S. Ser. No. 679,412, which was filed on Dec. 7, 1984, abandoned.

There are basically three types of dyed cellulosic fibers. There are those in which the dyes enter into a chemical reaction with the cellulose, forming covalent bonds. These are referred to as reactive dyed fibers. A second type includes those dyes which, applied to the cellulose from aqueous solutions, are subsequently rendered water insoluble once they are within the fiber phase. This group includes vat dyes, such as indigo sulfur dyes and azoic combinations. Thirdly, there are those water soluble dyes, known as direct dyes, which are not insolubilized in the fiber phase, but are held to the cellulose by physical forces of attraction, known variously as hydrogen bonding, non-polar van der Waals forces, Heitler-London forces, and others. These forces of attraction are relatively weak and dyeings are reversible.

During laundering or other immersion in aqueous media direct dyed materials may lose some of their color due to the leaching of the water soluble dye by the aqueous media. Reactive dyed materials display very little loss in color upon immersion since the dye molecules are covalently bound to the fiber molecules. The instant invention is directed to a process for improving the wet fastness or color retention of dyed materials. Reactive dyed materials are generally more expensive and the dyeing process is more complex than that used for preparing direct dyed materials. The advantage of the instant invention is that it significantly improves the wet fastness of the direct dyed materials. The instant process significantly reduces the loss of dye and, hence, maintains the shade intensity of the direct dyed materials during laundering.

DESCRIPTION OF THE INVENTION

The instant invention is directed to a dyed cellulosic material which has been treated with 0.1 to 5%, by weight, based on the weight of said material, of a polymer having an intrinsic viscosity of from about 0.05 to about 2.5 dl/g containing:

(A) 50 to 90%, by weight, based on the total weight of the polymer, of cationic mer units prepared from a cationic monomer selected from the group consisting of dimethyl diallyl ammonium chloride, diethyl diallyl ammonium chloride, methacryloyloxyethyl trimethyl ammonium chloride, methacryloyloxyethyl trimethyl ammonium methosulfate, methacrylamido propyl trimethyl ammonium chloride, acryloyloxyethyl trimethyl ammonium chloride and mixtures thereof;

(B) 10 to 50%, by weight, based on the total weight of the polymer, of reactive mer units selected from the group consisting of:

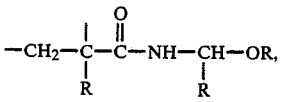

(i)

-continued

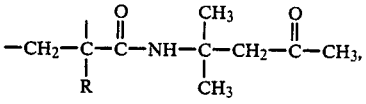

(ii)

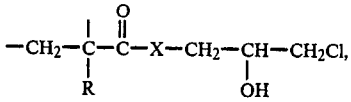

(iii)

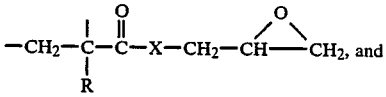

(iv)

(v) mixtures thereof, wherein R is a hydrogen or alkyl group of 1 to 6 carbon atoms, and X is an oxygen or NH group; and (C) 0 to 25%, by weight, based on the total weight of the polymer of inert mer units selected from the group consisting of:

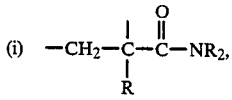

(i)

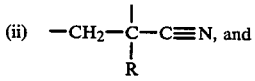

(ii)

(iii) mixtures thereof, wherein R, which may be the same or different, is a hydrogen or alkyl group of 1 to 6 carbon atoms.

The instant invention is also directed to a process for improving the wet fastness of dyed cellulosic materials, comprising treating the dyed cellulosic material with 0.1 to 5%, by weight, based on the weight of said material, of a polymer containing:

(A) 50 to 90%, by weight, based on the total weight of the polymer, of cationic mer units prepared from a cationic monomer selected from the group consisting of dimethyl diallyl ammonium chloride, diethyl diallyl ammonium chloride, methacryloyloxyethyl trimethyl ammonium chloride, methacryloyloxyethyl trimethyl ammonium methosulfate, methacrylamido propyl trimethyl ammonium chloride, acryloyloxyethyl trimethyl ammonium chloride and mixtures thereof;

(B) 10 to 50%, by weight, based on the total weight of the polymer, of reactive mer units selected from the group consisting of:

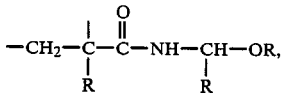

(i)

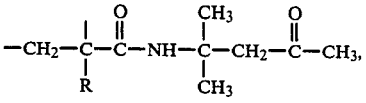

(ii)

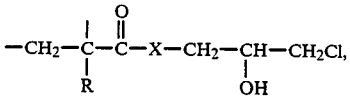

(iii)

-continued

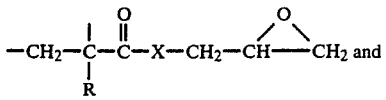

(iv)

(v) mixtures thereof wherein R is a hydrogen or alkyl group of 1 to 6 carbon atoms, and X is an oxygen or NH group; and (C) 0 to 25%, by weight, based on the total weight of the polymer of inert mer units selected from the group consisting of:

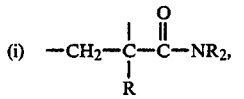

(i)

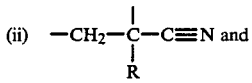

(ii)

(iii) mixtures thereof, wherein R, which may be the same or different, is a hydrogen or alkyl group of 1 to 6 carbon atoms.

The phrases "wet fast" and "wet fastness" refer to the ability of the material to retain its' color and not bleed during laundering or immersion in aqueous media.

The instant invention has been found to be effective with any cellulosic material. Examples of cellulosic material include cotton, viscose-rayon, and polyester blends with cotton and viscose-rayon. The preferred blends are 20 to 80%, by weight, polyester and 20 to 80%, by weight, cotton or viscose-rayon.

An improvement in the wet fastness of direct dyed materials has been found with the addition of as little as 0.1%, by weight, based on the weight of the material, of the polymer additive. Although polymer in excess of 5% may be added, the added cost often outweighs the value of any wet-fastness improvement caused by the increased dosage.

It is critical to the instant invention that the polymer additives are prepared from a cationic monomer and a reactive monomer. Inert monomers may optionally be used in the preparation of the polymer.

The cationic monomers which may be used in the instant invention, include dimethyl diallyl ammonium chloride (DMDAAC), diethyl diallyl ammonium chloride (DEDAAC), methacryloyloxyethyl trimethyl ammonium chloride (METAC), methacryloyloxyethyl trimethyl ammonium methosulfate (METAMS), methacrylamido propyl trimethyl ammonium chloride (MAPTAC), and acryloyloxyethyl trimethyl ammonium chloride (AETAC). More than one of the cationic monomers may be used in preparing the polymer. For example, it is common to use DMDAAC and DEDAAC in combination.

The reactive monomer used in preparing the polymer additive can be one of the following structures:

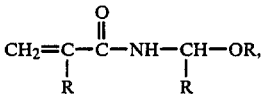

(i)

-continued

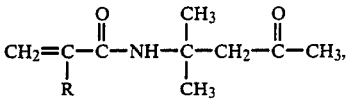

(ii)

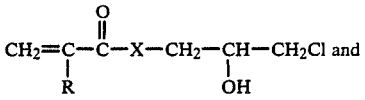

(iii)

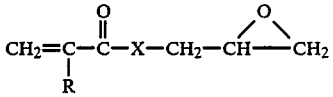

(iv)

wherein

R, which may be the same or different, is a hydrogen or straight branched alkyl group of 1 to 6 carbon atoms, and X is an oxygen or NH group. Mixtures of the reactive monomer may be used.

The inert monomers which may optionally be used in the instant invention can be of one of the following structures:

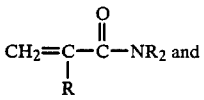

(i)

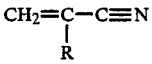

(ii)

wherein R, which may be the same or different, is a hydrogen or straight or branched alkyl group of 1 to 6 carbon atoms. Mixtures of the inert monomers may be used.

The polymers of the instant invention may also be prepared by conducting a reaction on an appropriate precursor polymer. For example, the reaction of formaldehyde with an acrylamide/DMDAAC copolymer can yield a polymer containing cationic mer units, and depending upon the stoichiometry and extent of the reaction with formaldehyde, cellulose reactive mer units via the introduction of the methylol unit on the amide linkage. If sufficient formaldehyde is used no inert mer units remain.

The polymers should contain from 50 to 90%, preferably 70–90%, by weight, based on the total weight of the polymer, of cationic mer units; 10–50%, preferably, 10–30%, by weight, based on the total weight of the polymer, of reactive mer units; and 0–25%, preferably 0–10%, by weight, based on the total weight of the polymer, of inert mer units.

Also, the polymers of the instant invention should have intrinsic viscosities ranging from about 0.05 to about 2.5 dl/g. Preferably, intrinsic viscosities should range from about 0.05 to about 0.5 dl/g.

The polymer may be added to the material by immersing the direct dyed cellulosic material in a bath of the polymer and subsequently extracting the material to 45 to 100% wet add on by vacuum extraction or squeezing through the pad rolls of a mangle. Other methods of treatment may include spraying and the like.

Treatment of the material with the polymer may be accelerated by the presence of a Lewis acid catalyst, such as magnesium chloride.

After treating the material with the polymer additive, the material is dried at room temperature or at temperatures ranging up to 450° F. in order to accelerate drying.

EXAMPLES

Cotton material, direct dyed and reactive dyed to various shades as indicated in the Table, were immersed in a polymer bath, dried at 220° F. for 2 minutes and then cured at 320° F. for 60 seconds.

To determine the wet fastness properties of the treated materials, AATCC No. 2A wash test was performed on the materials. In this test the material is washed under standard conditions in the presence of a piece of undyed white cotton material. The test measures the staining of the white cotton due to the transfer of dye from the dyed material via the solution, during the wash cycle, and rates the degree of staining on a scale of 1 to 5, where 1 is very poor, i.e. very heavy staining, and 5 is no staining at all. Examples 1 and 2 are the blanks used for comparison. The results are summarized in the Table.

TABLE

| | | | AATCC No. 2 Wash:Stain on White Cotton | | | | | | |
|---|---|---|---|---|---|---|---|---|---|
| Example | Dye Type | Additive[1] | dosage, % by wt. polymer | gold | light red[3] | dark red | brown | navy | turquoise |
| 1 | direct | blank | 0 | 3–4 | 4 | 2 | 2–3 | 2 | 4 |
| 2 | reactive | blank | 0 | 5 | 5 | 4–5+ | 4–5+ | 4–5+ | 4–5+ |
| 3 | direct | DMDAAC/AM[2] | 3.0 | 5 | 5 | 4–5 | 4–5 | 4–5 | 4–5+ |
| 4 | direct | DMDAAC/AM | 1.5 | 5 | 4–5+ | 4 | 4–5 | 4–5 | 4–5+ |
| 5 | direct | DMDAAC/AM | 0.75 | 4–5 | 4–5+ | 3–4 | 4 | 4 | 5 |

[1]All of the materials, including the blanks, were treated in order to give them 3% glyoxal resin and 0.6% magnesium chloride catalyst on the weight of the material. (This is the basic chemical content of most conventional crease-resistant finishes for cellulosic materials; however, the use of other conventional thermosetting resins is not precluded.) The polymers used in Examples 3 through 5 were mixed in the resin/catalyst solutions.
[2]DMDAAC/AM = 80/20 dimethyl diallyl ammonium chloride and N—methylol acrylamide, $CH_2{=}CHCONHCH_2OH$, copolymer.
[3]4–5+ means better than 4–5 (which is half way between 4 and 5), but not quite as good as 5.

What is claimed is:

1. A dyed cellulosic material which has been treated with 0.1 to 5%, by weight, based on the weight of said material, of a polymer having an intrinsic viscosity of from about 0.05 to about 2.5 dl/g containing:

(A) 50 to 90%, by weight, based on the total weight of the polymers, of cationic mer units prepared from a cationic monomer selected from the group consisting of dimethyl diallyl ammonium chloride, diethyl diallyl ammonium chloride, methacryloyloxyethyl trimethyl ammonium chloride, methacryloyloxyethyl trimethyl ammonium methosulfate, methacrylamido propyl trimethyl ammonium chloride, acryloyloxyethyl trimethyl ammonium chloride and mixtures thereof;

(B) 10 to 50%, by weight, based on the total weight of the polymer, of reactive mer units selected from the group consisting of:

(i) $-CH_2-C(R)-C(=O)-NH-CH(R)-OR$, (ii) $-CH_2-C(R)-C(=O)-NH-C(CH_3)_2-CH_2-C(=O)-CH_3$,

-continued (iii) $-CH_2-C(R)-C(=O)-X-CH_2-CH(OH)-CH_2Cl$, and (iv) mixtures thereof, wherein R, which may be the same or different, is a hydrogen or straight or branched alkyl group of 1 to 6 carbon atoms, and X is an oxygen or NH group; and (C) 0 to 25%, by weight, based on the total weight of the polymer of inert mer units selected from the group consisting of:

(i) $-CH_2-C(R)-C(=O)-NR_2$, (ii) $-CH_2-C(R)-C\equiv N$, and (iii) mixtures thereof, wherein R, which may be the same or different, is a hydrogen or alkyl group of 1 to 6 carbon atoms.

2. A process for improving the wet fastness of dyed cellulosic materials, comprising treating the dyed cellulosic materials, comprising treating the dyed cellulosic material with 0.1 to 5%, by weight, based on the weight of said material, of a polymer having an intrinsic viscosity of from about 0.05 to about 2.5 dl/g containing:

(A) 50 to 90%, by weight, based on the total weight of the polymer, of cationic mer units prepared from a cationic monomer selected from the group consisting of dimethyl diallyl ammonium chloride, diethyl diallyl ammonium chloride, methacryloyloxyethyl trimethyl ammonium chloride, methacryloyloxyethyl trimethyl ammonium methosulfate, methacrylamido propyl trimethyl ammonium chloride, acryloyloxyethyl trimethyl ammonium chloride and mixtures thereof;

(B) 10 to 50%, by weight, based on the total weight of the polymer, of reactive mer units selected from the group consisting of:

(i) $-CH_2-C(R)-C(=O)-NH-CH(R)-OR$,

-continued (ii) $-CH_2-\underset{\underset{R}{|}}{C}-\overset{\overset{O}{\|}}{C}-NH-\underset{\underset{CH_3}{|}}{\overset{\overset{CH_3}{|}}{C}}-CH_2-\overset{\overset{O}{\|}}{C}-CH_3$, (iii) $-CH_2-\underset{\underset{R}{|}}{\overset{\overset{O}{\|}}{C}}-C-X-CH_2-\underset{\underset{OH}{|}}{CH}-CH_2Cl$, and (iv) mixtures thereof, wherein R, which may be the same or different is a hydrogen or straight or branched alkyl group of 1 to 6 carbon atoms, and X is an oxygen or NH group; and (C) 0 to 25%, by weight, based on the total weight of the polymer of inert mer units selected from the group consisting of:

(i) $-CH_2-\underset{\underset{R}{|}}{\overset{\overset{O}{\|}}{C}}-C-NR_2$,

-continued (ii) $-CH_2-\underset{\underset{R}{|}}{\overset{\overset{|}{}}{C}}-C\equiv N$ and (iii) mixtures thereof, wherein R, which may be the same or different, is a hydrogen or alkyl group of 1 to 6 carbon atoms.

3. The material of claim 1, wherein said polymer is prepared from dimethyl diallyl ammonium chloride and N-methylol acrylamide.

4. The material of claim 1, wherein 70 to 90%, by weight, of said cationic mer units; 10 to 30%, by weight, of said reactive mer units; and 0 to 10%, by weight, of said inert mer units are present in the polymer.

5. The material of claim 1, wherein said material is cotton.

6. The material of claim 1, wherein said material is a blend of 20 to 80%, by weight, polyester and 20 to 80%, by weight, cotton.

7. The process of claim 6, wherein said polymer is prepared from dimethyl diallyl ammonium chloride and N-methylol acrylamide.

8. The process of claim 6, wherein 70 to 90%, by weight, of said cationic mer units; 10 to 30%, by weight, of said reactive mer units; and 0 to 10%, by weight, of said inert mer units are present in the polymer.

* * * * *